United States Patent [19]

Reinehr et al.

[11] 4,257,999

[45] * Mar. 24, 1981

[54] PROCESS FOR THE PRODUCTION OF HYDROPHILIC FILAMENTS AND FIBRES BY THE DRY JET WET-SPINNING METHOD

[75] Inventors: Ulrich Reinehr, Dormagen; Frank Druschke, Krefeld, both of Fed. Rep. of Germany

[73] Assignee: Bayer Aktiengesellschaft, Leverkusen, Fed. Rep. of Germany

[ * ] Notice: The portion of the term of this patent subsequent to Sep. 23, 1997, has been disclaimed.

[21] Appl. No.: 931,955

[22] Filed: Aug. 8, 1978

[30] Foreign Application Priority Data

Aug. 10, 1977 [DE] Fed. Rep. of Germany ..... 2736065

[51] Int. Cl.[3] ..... D01F 6/18

[52] U.S. Cl. ..... 264/203; 264/206; 264/211

[58] Field of Search ..... 264/206, 211, 203

[56] References Cited

U.S. PATENT DOCUMENTS

| | | | |
|---|---|---|---|
| 2,032,606 | 3/1936 | Whitehead | 264/207 |
| 2,303,340 | 12/1942 | Dreyfus | 264/176 F |
| 2,303,528 | 12/1942 | Dreyfus | 264/176 F |
| 2,367,493 | 1/1945 | Fordyce et al. | 264/176 F |
| 2,425,782 | 8/1947 | Bludworth et al. | 264/203 |
| 2,688,010 | 8/1954 | Chaney | 264/206 |
| 2,876,494 | 3/1959 | Janssen et al. | 264/206 |
| 3,415,922 | 12/1968 | Carter et al. | 264/205 |
| 3,842,151 | 10/1974 | Stoy et al. | 264/203 |

FOREIGN PATENT DOCUMENTS

| | | | |
|---|---|---|---|
| 730902 | 6/1955 | United Kingdom | 264/206 |

*Primary Examiner*—Jay H. Woo

*Attorney, Agent, or Firm*—Sprung, Felfe, Horn, Lynch & Kramer

[57] ABSTRACT

The invention relates to a process for the production of hydrophilic filaments or fibres having a sheath/core structure, a porosity of at least 10% and a water retention capacity of at least 10% and having a fibre swelling factor which is lower than the water retention capacity. The process is carried out by spinning a solution of a fibre forming synthetic polymer, especially an acrylonitrile polymer by the dry jet wet-spinning method wherein immediately on leaving the spinning jet and prior to coagulation in the precipitation bath the filaments or fibres are contacted with steam or with the vapor of another liquid which coagulates the filaments.

5 Claims, No Drawings

PROCESS FOR THE PRODUCTION OF HYDROPHILIC FILAMENTS AND FIBRES BY THE DRY JET WET-SPINNING METHOD

This invention relates to a process for the production of hydrophilic filaments or fibres with a sheath/core structure from filament-forming polymers, particularly acrylonitrile homopolymers or copolymers, by the dry jet, wet-spinning method in the presence of steam as first precipitation medium for polyacrylonitrile filaments.

The dry jet, wet-spinning method is generally used to facilitate drawing of the filaments, to reduce the porosity of the fibre structure (cf. German Offenlegungsschrift No. 1,660,463) or even to improve the natural colour of the filaments, as described in U.S. Pat. No. 3,415,922. According to German Offenlegungsschrift No. 1,660,463, the distance between the jet and the surface of the bath should amount to no more than 11.4 cm in order to prevent the individual spun filaments from combining with and adhering to one another. This maximum allowable distance of 11.4 cm is achieved by passing the filaments through a mist-like atmosphere of atomized water, the spinning solvent or a mixture of both, which is sprayed very finely into a chamber from nozzles with air as the propellant, before the filaments are completely coagulated in the precipitation bath, in order to intensify the initial coagulation of the extruded filament-forming material.

It has now surprisingly been found that, instead of non-porous fibres, highly porous and hydrophilic acrylic fibres with a sheath/core structure can be obtained by the dry jet wet spinning method providing steam is used as the first precipitation medium instead of finely atomised water-air mixtures or water-air-solvent mixtures.

Accordingly, the present invention provides a process for the production of porous hydrophilic filaments of fibres having a sheath/core structure, from filament-forming synthetic polymers having a porosity of at least 10% and a water retention capacity of at least 10% and having a fibre swelling factor which is lower than the water retention capacity by spinning a polymer solution by the dry jet, wet spinning method, wherein, immediately they leave the spinning jet and before entering the actual coagulation process in the precipitation bath, the filaments are brought into contact with steam or with the vapour of another liquid which coagulates the filaments.

In this process, i.e. where steam or another vapour is used, the maximum distance to be maintained between the jet and the surface of the bath of 11.4 cm, as it is known from the above-cited German Offenlegungsschrift, is no longer a critical factor. The distance between the jet and the precipitation bath may amount, for example, to 50 cm and more without encountering the problems of the filaments combining with and adhering to one another.

The steam is best injected centrally into the spinning duct above the jet. Vapour/air mixtures may also be used. In general, quantities of vapour amounting to approximately 1 kg of vapour per kg of spun material are sufficient for obtaining hydrophilic acrylic fibres with a sheath/core structure where the polyacrylonitrile solution used for spinning has a concentration of around 30%.

Polymers which are not normally hydrophilic, preferably acrylonitrile polymers and, with particular preference, acrylonitrile polymers containing at least 50% by weight and more especially at least 85% by weight of acrylonitrile units can be spun by the process according to the invention.

In addition to steam, vapours suitable in accordance with the invention for precoagulating the as yet unsolidified filaments include the vapours of any substances which represent non-solvents for the spun polymers, particularly acrylonitrile polymers, for example, in the case of acrylonitrile polymers, mono- and poly- substituted alkyl ethers and esters of polyhydric alcohols, such as diethylene glycol, tripropylene glycol and glycol ether acetates. Alcohols such as 2-ethyl cyclohexanol, glycerol, esters or ketones or mixtures of, for example, ethylene glycol acetates are also suitable. In addition to water, particularly preferred substances are readily volatile substances of high flashpoint and low flammability, for example methylene chloride and carbon tetrachloride.

Through the intensity with which the vapour is blown onto the polymer filaments, it is possible to control both the cross-sectional structure and also the sheath width and hydrophilicity of the filaments.

According to the invention, the sheath width may be controlled by selecting the ratio of air to vapour mixture or simply the quantity of vapour so that, with large quantities of vapour sheath/core fibres with a larger sheath width amounting to as much as around 75% of the total fibre cross-section, are preferably obtained.

If, on the other hand, only a little vapour is used during the spinning process, the sheath/core fibres obtained increasingly resemble the cross-sectional structure normally obtained in wet spinning and they have a correspondingly low water retention capacity.

The cross-sectional structure of the sheath/core fibres was determined from photographs taken with an electron microscope. For determining the core and sheath surfaces of the fibres, the cross-sections of approximately 100 fibres were evaluated by quantitative analysis using the "Classimat" image analyser manufactured by the LEITZ company.

In the process according to the present invention, the vapour is preferably injected above the spinning jet in the direction in which the filament is drawn off. However, the vapour may also be injected below the spinneret transversely of the filaments, providing no excessive turbulence is generated in this way.

By virtue of their porous core/sheath structure, the filaments and fibres produced by the process according to the invention are highly absorbent, take up water without swelling, rapidly transport moisture, have a high moisture-absorption capacity and, again by virtue of their porous structure, a low density. Accordingly, the combination of all these positive properties in a single fibre enables the fibres to be made up into textile articles, particularly articles of clothing, which are extremely comfortable to wear.

The physical values by which the filaments are characterised were determined as described in the following. These measuring methods apply to dyed and blank-dyed preparation-free fibres, yarns or sheet-form textiles.

MEASURING METHODS

Mercury Density Determination (ρHg)

After the sample has been heated in vacuo ($10^{-2}$ mbar) at 50° C., the Hg-density (mean apparent density) is determined by volume measurements in mercury under an excess pressure of 10 bars.

Helium Density Determination (ρHe)

After the sample has been heated in vacuo ($10^{-2}$ bars) at 50° C., the helium density ("true density") is determined by volume measurement in helium using a gas comparison pycnometer.

Definition of Porosity (P)

$$P=[1-(\rho Hg/\rho He)].\ 100\%$$

Definition of the Core-Jacket Structure

In a scanning electron microscope, samples prepared by standard techniques (low-temperature fracture, ion etching and vapour deposition of gold) show in cross-section a core-jacket structure which is characterised in that the pores discernible in the core are on average distinctly larger than the pores in the jacket. The jacket may, in particular, appear compact, i.e. in general it has no pores exceeding 300 Å in diameter.

The thickness of the jacket representing the surface of the fibre is determined as the distance from the outside of the fibre (progressing vertically inwards) to the point at which the difference in structure mentioned above is discernible.

Determination of Water Retention Capacity (WR)

Water retention capacity is determined in accordance with DIN 53814 (cf. Melliand Textilberichte 4 1973, page 350).

The fibre samples are immersed for 2 hours in water containing 0.1% of a wetting agent. The fibres are then centrifuged for 10 minutes with an acceleration of 10,000 m/sec$^2$. and the quantity of water retained in and between the fibres is gravimetrically determined. To determine the dry weight, the fibres are dried at 105° C. until they have a constant moisture content. The water retention capacity (WR) in % by weight is:

$$WR=(m_f-m_{tr}m/_{tr})\times 100$$

$m_f$=weight of the moist fibres $m_{tr}$=weight of the dry fibres.

The invention is further illustrated but not intended to be limited by the following Examples in which the parts and percentages quoted are based on weight, unless otherwise indicated.

EXAMPLE 1

An acrylonitrile copolymer of 93.6% of acrylonitrile, 5.7% of methylacrylate and 0.7% of sodium methallyl sulphonate was dissolved in dimethyl formamide (DMF) at a temperature of 80° C. The filtered spinning solution, which had a final concentration of approximately 30% by weight, was spun vertically from a 24-bore ring jet through a vapour atmosphere into an aqueous coagulation bath. The jet was provided at its centre with a sieve-like distributor through which the vapour was passed into a 50 cm long tube 275 mm in diameter which terminated approximately 2 cm above the aqueous precipitation bath. The vapour temperature was 112° C. 9.5 kg/hour of vapour was passed through the tube. A water/DMF mixture in a ratio of 1:1 was used as the bath liquid. The filaments were run off at 61.5 meters per minute and, after the vapour zone, passed through a precipitation bath with a total length of 60 cm.

The filaments were then drawn in a ratio of 1:6 in boiling water (80° C.), washed in water and dried at 100° C. The individual filaments with a final denier of 3.3 dtex had a water retention capacity according to DIN 53814 of 42%. The filaments had a pronounced core/jacket structure with an irregular, repeatedly indented cross-sectional form. The jacket surface made up approximately 20% of the total cross-section. Porosity amounted to 31.8% ($\rho_{He}$=1.175; $\rho_{Hg}$=0.802).

EXAMPLE 2

An acrylonitrile copolymer with the same chemical composition as in Example 1 was spun in the same way as described in Example 1. The vapour temperature was 105° C. 11 kg/hour of vapour were passed through the tube. The coagulation bath contained a mixture of 35% of DMF and 65% of water. The precipitation bath was 80 cm long. The filaments were again run off from the jet at 61.5 meters per minute and similarly drawn, washed and dried. The individual filaments with a final denier of 3.3 dtex had a water retention capacity of 43%. The filaments again had a pronounced core/jacket structure with a bean-shaped to oval cross-sectional form. The jacket surface made up approximately 30% of the total cross-section. Porosity amounted to 31.7% ($\rho_{He}$=1.170; $\rho_{Hg}$=0.799).

EXAMPLE 3

An acrylonitrile copolymer with the same chemical composition as in Example 1 was spun, drawn and aftertreated to form filaments in the same way as described in Example 2. The coagulation bath consisted of pure water. The individual filaments with a final denier of 3.3 dtex had a water retention capacity of 43%. The filaments again had a core/jacket structure with a bean-shaped to trilobal cross-sectional form. The jacket surface made up approximately 30% of the total cross-section. Porosity amounted to 32.0% ($\rho_{He}$=1.180; $\rho_{Hg}$=0.803).

EXAMPLE 4

Part of the spinning solution of Example 1 was spun and aftertreated in the same way as described in that Example. The vapour throughput amounted to 5 kg per hour. The vapour temperature was 110° C. The coagulation bath consisted of 40% of DMF and 60% of water. The precipitation bath was 50 cm long. The individual filaments with a final denier of 3.3 dtex had a water retention capacity of 36%. The filaments again had a core/jacket structure with an irregular trilobal to mushroom-shaped cross-sectional form. The jacket surface made up approximately 15% of the total cross-section. Porosity amounted to 28.4% ($\rho_{He}$=1.180; $\rho_{Hg}$=0.845).

EXAMPLE 5 (Comparison)

Another part of the spinning solution of Example 1 was spun in the same way as described in that Example. Instead of vapour, air heated to 115° C. was blown through the tube and the filaments were coagulated in a precipitation bath, drawn and aftertreated in the same way as described in Example 1. The individual filaments with a final denier of 3.3 dtex had a bean-shaped to oval cross-sectional form, but not a core/jacket structure. The water retention capacity amounted to 6%. Porosity amounted to 4.5% ($\rho_{He}=1.180$; $\rho_{Hg}=1.128$).

We claim:

1. A process for the production of hydrophilic polyacrylonitrile filaments or fibres having a sheath/core structure, a porosity of at least 10% and a water-retention capacity of at least 10% and having fibre swelling factor which is lower than the water-retention capacity, wherein a solution of a filament forming synthetic polymer acrylonitrile is spun by the dry jet, wet spinning method, wherein, immediately on leaving the spinning jet and prior to coagulation in a precipitation bath, the filaments are contacted with superheated steam or with the vapour of another liquid which coagulates the filaments and wherein the resulting filaments are coagulated in a precipitation bath and subsequently drawn.

2. The process of claim 1, wherein the polymer comprises at least 50% by weight of acrylonitrile units.

3. The process of claim 1, wherein the filaments are contacted with superheated steam prior to coagulation in a precipitation bath.

4. A process according to claim 1 wherein said precipitation bath contains a liquid.

5. A process according to claim 1 wherein the distance between the spinneret and the precipitation bath is greater than 11.4 centimeters and up to 50 centimeters and said precipitation bath comprises a liquid.

* * * * *